United States Patent [19]

Combs

[11] Patent Number: 4,932,912

[45] Date of Patent: Jun. 12, 1990

[54] AQUATIC RECREATIONAL APPARATUS

[76] Inventor: David A. Combs, 2844 Larch Ave., Central Point, Oreg. 97502

[21] Appl. No.: 373,096

[22] Filed: Jun. 28, 1989

[51] Int. Cl.[5] ..... A63H 23/10

[52] U.S. Cl. ..... 441/129; 222/78; 272/1 B

[58] Field of Search ..... 222/78, 79; 272/1 B; 273/349, 350; 441/129, 130, 131, 132, 65, 66, 71; 440/39

[56] References Cited

U.S. PATENT DOCUMENTS

| | | | |
|---|---|---|---|
| 2,801,850 | 8/1957 | Yount | 272/1 B |
| 3,384,047 | 5/1968 | Remley | 440/39 |
| 3,823,847 | 7/1974 | Ware | 222/79 |

*Primary Examiner*—Sherman D. Basinger
*Assistant Examiner*—Thomas J. Brahan
*Attorney, Agent, or Firm*—Kolisch, Hartwell & Dickinson

[57] ABSTRACT

Aquatic recreational apparatus providing in an integral structure a kick board and manually operable means for directing a stream of water toward a desired target is described. The apparatus in its preferred embodiment takes the form of a smooth, contoured kick board having dual, laterally spaced handles and integral therewith trigger means for manually operating corresponding pumps. A pair of first fluid conduits extends from dual, laterally spaced inlets located in a rearward region of the kick board to first sides of the pumps, and a pair of second fluid conduits extends therefrom forwardly to laterally spaced nozzles in the extreme forward region of the kick board. The laterally spaced handles provide a secure grip to the user whose upper body is supported by the kick board, while the user maneuvers the kick board by pedal action into a position suitable for directing a stream of water from the body of water in which the kick board is being used toward a desired target remote from the apparatus.

4 Claims, 1 Drawing Sheet

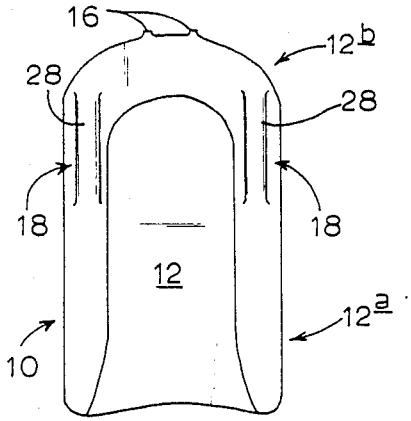
FIG. 1
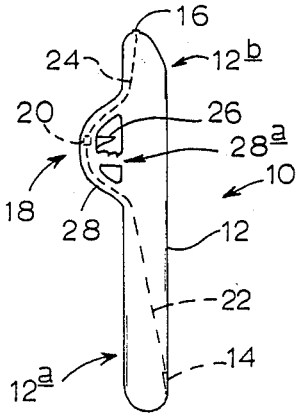
FIG. 2
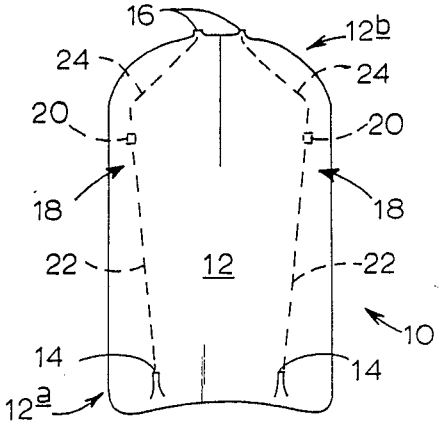
FIG. 3
FIG. 4
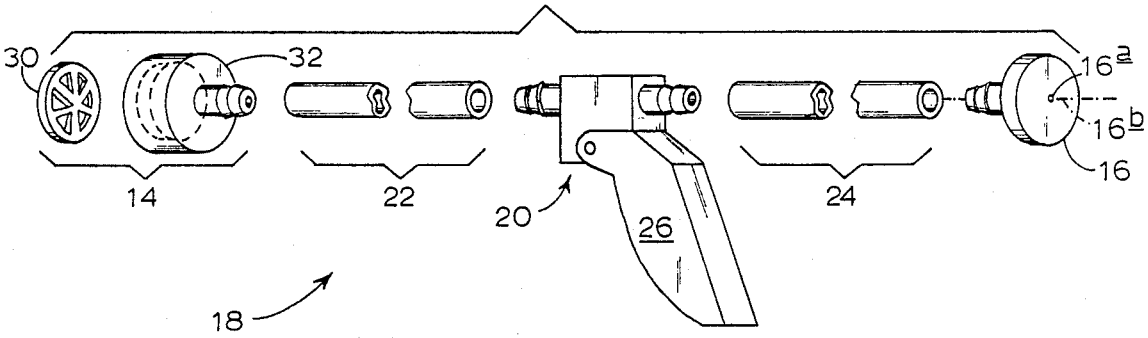
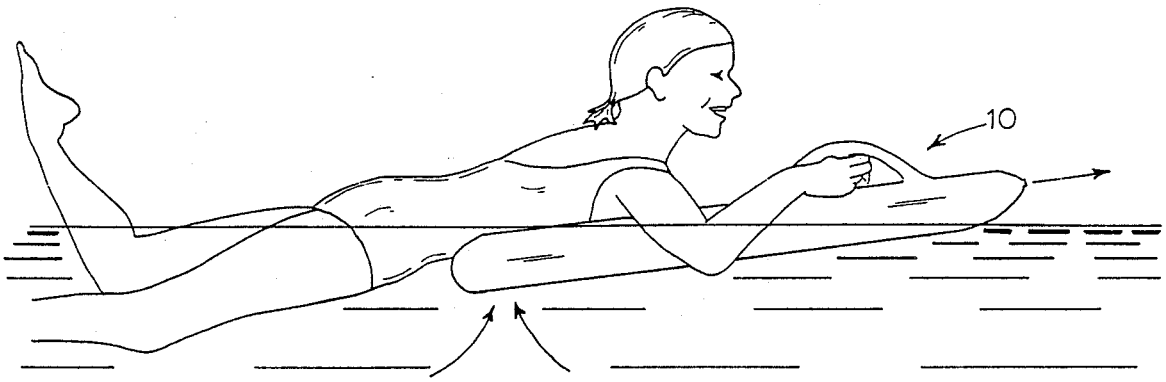
FIG. 5

AQUATIC RECREATIONAL APPARATUS

BACKGROUND AND SUMMARY OF THE INVENTION

This invention relates generally to aquatic recreational apparatus. More particularly, this invention concerns apparatus, for use in a body of water, comprising a kick board and user-operable means for directing a stream of water at a remote target.

Kick boards for use in swimming pools are well-known. A kick board provides for the floatation of the upper body of a user who grips the edges of the board while kicking to propel the board through the water. Kick boards traditionally serve more of a training than a recreational purpose, as they commonly are used in teaching beginners to swim, and in muscle rehabilitative therapy or developmental training.

It is desirable to increase the recreational uses of kick boards in order to provide their users with greater enjoyment. A kick board equipped with means manually operable by the user to direct a stream of water from the body of water in which the kick board is being used toward a target remote from the kick board, e.g. an opponent with a similarly equipped kick board, would provide a more recreational form of exercise.

Accordingly, it is a principal object of the present invention to provide a unitary structure that is capable of supporting the upper body of a user in a body of water, while enabling the user to direct one or more streams of water from the body of water toward a desired target.

Another object of the invention is to provide such apparatus that requires no internal water reservoir, but rather uses as its reservoir the body of water in which the apparatus is used.

Yet another object is to provide such apparatus that can be safely operated by its user.

A further object of the invention is to provide such apparatus that comfortably accommodates users of various sizes.

Another important object is to provide such apparatus that is easily and inexpensively manufactured.

Briefly, the invention integrally combines laterally spaced, manually operable pumps having triggers that may be operated by a user positioned prone on a rearward region of a buoyant kick board. Each of the trigger-actuable pumps is adjacent one of a pair of laterally spaced, easily gripped handles. Water that enters inlets in the underside of a rearward region of the kick board is drawn toward the pumps via a pair of first fluid conduits, and is expelled from nozzles via a pair of second fluid conduits that extend from the pumps to the leading edge in the forward region of the kick board.

Because the apparatus of the invention assumes an inclined attitude in the water, under the weight of the user, its rearward region in which are located the water inlets perpetually is submersed in water, while its forward region including the pumps and their corresponding nozzles perpetually extend into the air above the level of the water. The user may aim a stream of water at a desired target remote from the apparatus by paddling, thereby to maneuver the kick board into a proper position and orientation in the water. Thus, the apparatus of the invention provides clean and safe fun; it develops eye and limb coordination; and it promotes quadripedal stimulation and exercise.

These and other objects and advantages of the invention will become more fully apparent when the detailed description below is read with reference to the accompanying drawings.

BRIEF DESCRIPTION OF THE DRAWINGS

FIG. 1 is a top view of the apparatus made in accordance with the preferred embodiment of the invention.

FIG. 2 is a side elevation corresponding to FIG. 1.

FIG. 3 is a bottom view of the apparatus showing, in dashed lines, the preferred routing of the water conveying conduits.

FIG. 4 is an exploded, fragmentary diagram of the water conveying-directing means.

FIG. 5 is a side elevation of the apparatus in a body of water, and shows the inclined attitude that the apparatus assumes under the weight of a user.

DETAILED DESCRIPTION OF THE PREFERRED EMBODIMENT

Referring collectively to FIGS. 1 through 3, an aquatic recreational device, or aquatic recreational apparatus, made in accordance with the preferred embodiment of the invention is indicated generally at 10. Apparatus 10 comprises floatation means, or a kick board, 12 for supporting the upper body of a user in a body of water, with the floatation means having at least one inlet 14 in a rearward region 12*a* and at least one outlet 16 in a forward region 12*b* thereof. Apparatus 10 further comprises user-actuable means, which is indicated generally at 18, connected with the floatation means for conveying water between inlet 14 and outlet 16 toward a desired target remote from apparatus 10. FIG. 1 shows apparatus 10 in a top view; FIG. 2 shows apparatus 10 in a side elevation; FIG. 3 shows apparatus 10 in a bottom view.

In its preferred embodiment, apparatus 10 is a unitary, molded structure that is buoyant. Depending upon its desired buoyancy, apparatus !0 may be a hollow structure that displaces more than its weight of water, or it may be a solid structure that is less dense than water. Apparatus 10 preferably is concavely contoured in an upper central region outlined in FIG. 1 comfortably to accommodate by cradling the upper body of a user, and preferably has a smoothly finished outer surface. Conventionally available materials and methods, such as those that are known to be used in the fabrication of conventional kickboards, paddleboards or other floatation devices, are effective in the manufacture of apparatus 10.

Rendering apparatus 10 unique is the provision of conventional kick board 12 with means 18 for conveying water from rearward region 12*a* to forward region 12*b*, and for directing the water toward a desired target. In its preferred embodiment, means 18 includes dual, laterally spaced inlets 14; dual, laterally spaced outlets or nozzles 16; dual, laterally spaced, manually operable pumps 20 interposed forward and rearward regions 12*b*, 12*a*; and first and second pairs of fluid conduits 22, 24 (shown in dashed lines in FIGS. 2 and 3) that extend, respectively, between inlets 14 and one side of pumps 20 and between the other side of pumps 20 and outlet 16. Each of said pumps 20 is independently operable by digitally actuable trigger means adjacent, and preferably forming a part of, gripping means, or grippable handles 28. Thus, conveying-directing means 18 enables a user of apparatus 10 selectively, independently to direct one or more streams of water from the body of water in which kick board 12 is floating toward a target remote from apparatus 10.

As may be seen best in FIGS. 1 and 2, handles 28, which are rigidly joined with kick board 12, provide an important safety feature of apparatus 10. By what will be referred to as a pistol grip 28*a*, handles 28 may be securely gripped, whereby each of trigger means 26 is actuable by a user while the user safely is gripping handles 28 and, consequently, the floatation means. Because of this important safety feature, the use of apparatus 10 is safe as well as fun.

Referring still to FIGS. 1 through 3, apparatus 10 is described using different terminology but the same reference designators. Device 10 may be described as comprising an elongate floatation body 12 including a front end 12*b* and a rear end 12*a*. Device 10 may be seen also to comprise user-actuable water-stream projection means 18 for projecting at least one stream of water outwardly from front end 12*b* of body 12, along a maneuverable trajectory substantially defined by the orientation of the long axis of body 12. The long axis of body 12, and consequently the water stream's trajectory, is maneuverable by the user of device 10 by paddling device 10 into a desired position relative to a target. Thus, while the water stream's trajectory may be fixed relative to body 12, nevertheless it is maneuverable by the user's maneuvering of body 12 itself within a body of water.

Turning now to FIG. 4, one of dual conveying-directing means 18 is illustrated in an exploded, fragmentary view, it being understood that the other means 18 would be identically described. In the preferred embodiment, inlet 14 includes a filter 30 for preventing particulate from entering first conduit 22 (and potentially reducing its ability to communicate fluid) and a suitable couple 32 for retaining filter 30 and for providing a rigid, sealed connection for conduit 22. Conduit 22 may be formed of any suitable plastic tubing, preferably approximately ⅛–¼ inch in diameter. Conduit 22 extends from inlet 14 to connect to one (upstream) side of pump 20, which may be a very simple siphon or plunger, whether suction or pressure, pump (capable when operated of providing a pressure differential from one side to the other) such as is commonly used in household spray bottles, although those skilled in the art will appreciate that any suitable pump will serve. For example, within the spirit of the invention, an electrically operated pump may be used in apparatus 10, and its actuation means integrally formed within the area of handles 18 to permit its manual operation by a user of apparatus 10. Extending from another (downstream) side of pump 10 to connect to outlet 16 is second conduit 24, which may be formed of any suitable plastic tubing preferably of slightly smaller diameter than that of conduit 22. Finally, outlet 16 having provision for the rigid, sealed connection thereto of conduit 24 is provided with an orifice 16*a* having a diameter of preferably approximately 1/16 inch. It will be understood that inlet 14 and outlet 16 are rigidly mounted to kick board 12, which mounting may be accomplished in any suitable manner that does not impair the buoyancy of kick board 12.

Importantly, the orientation of a central axis 16*b* of outlet 16 relative to the longitudinal axis of kick board 12 substantially determines the trajectory of the stream of water expelled from apparatus 10. In the preferred embodiment, axis 16*b* is fixed in a parallel orientation with the longitudinal axis of kick board 12, thereby to fix the trajectory in line with kick board 12. It will be appreciated that straightforward variations in the orientation, location or means for mounting outlet 16 on kick board 12 may be made within the spirit of the invention. One or more such means 18 may be provided in a kick board, as illustrated and described herein, so that the squeezing of one or more triggers effects single- or double-barreled squirt gun-like action. Those of skill in the art also will appreciate that alternative means may be provided for conveying and directing water, from the body of water in which apparatus 10 is used, toward a remote target.

Referring to FIG. 5, apparatus 10 may be seen in use within a body of water. The upper body of a prone user is shown supported for floatation within the body of water, with the user securely gripping handles 28 and manually operating one or both of trigger means 26 with her fingers. Water entering inlets 14 is conveyed, as indicated by arrows, by first fluid conduits 22 towards one side of pumps 20. The user's selective actuation of trigger means 26 propels water through pumps 20 and directs it through second fluid conduits 24 toward outlets 16. Water is expelled toward a desired remote target in at least one stream therefrom, as indicated by arrows, the trajectory of which is defined by the user's orientation of kick board 12 within the body of water, whereby kick board 12 is maneuverable by pedal action of the user, e.g. by kicking her feet, into a position that aligns such trajectory with such target.

Importantly, apparatus 10 assumes an attitude within the body of water, under the weight of its user, somewhat inclined from the horizontal, thereby providing a substantial range, e.g. twenty to thirty feet, in which a target remote from apparatus 10 may be hit. Equally importantly, the configuaration of inlets 14, pumps 20 and outlets 16, coupled with the inclined attitude apparatus 10 assumes near the surface of the body of water, insures that an inexhaustible source of water will be available at inlets 14, which are perpetually submersed in the body of water. The configuration also ensures that pumps 20 will be above the surface of the body of water, thereby to avoid the requirement of vacuum lines. Finally, the configuration ensures that outlet 16 perpetually will be above the surface of the body of water, in order to permit continuous use of conveying-directing means 18 by the user.

Greatly improved floatation apparatus are provided, in the form of a buoyant kick board having handles for its secure gripping. The improvement may be understood to comprise user-actuable means, which is integral with floatation apparatus for supporting the upper body of user in a body of water with the rearward region of the apparatus submersed therein and with a forward region of the apparatus extending thereabove, for conveying water from the rearward region to the forward region under sufficient pressure to expel a stream water away from the apparatus toward a remote target. In the preferred embodiment, the conveying means includes dual laterally spaced, manually operable pumps positioned in a forward region of the apparatus extending above the water, with each pump being operatively connected in fluid communication with a corresponding, laterally spaced inlet formed in the rearward region of the apparatus and with a corresponding laterally spaced outlet formed in the forward region thereof. Finally, in the preferred embodiment, each pump has pistol grip means providing for the secure gripping of the floatation apparatus and for the selective operation of the pumps by the user.

The objects and advantages of the invention thus are realized. The trajectory of the streams of water is substantially determined, in accordance with the preferred embodiment of the invention, by the orientation of the long axis of the kickboard in the body of water in which it is floating, which orientation may be controlled by the user's paddling or kicking. The apparatus may be safely used, without risk of upset, by the provision of easily gripped, integrally formed, laterally spaced handles. No internal water reservoir is needed, as the improved apparatus of the invention in its preferred embodiment uses as its source of water the body of water in which it is floating. The smoothly contoured surfaces, including a concavely contoured central region in the upper surface of the kick board, permit the apparatus of the invention to accommodate users of various sizes. The apparatus uses inexpensive and readily available components, thereby making it easily and inexpensively manufactured. Incidentally providing a form of exercise for the user while she is maneuvering the apparatus around in, for example, a swimming pool, the apparatus principally provides a recreational user with hours of single- or double-barreled fun.

Accordingly, while a preferred embodiment of the apparatus of the invention has been described herein, it is appreciated that modifications are possible that come within the scope of the invention.

It is claimed and desired to be secured by Letters Patent:

1. In flotation apparatus for supporting the upper body of a user in a body of water with a rearward region of the apparatus submersed therein and with a forward region of the apparatus extending thereabove, the improvement comprising:

user-actuable means integral with the apparatus for conveying water from the rearward region to the forward region of the apparatus under sufficient pressure to expel a stream of water away from the apparatus toward a remote target, wherein said conveying means includes dual laterally spaced manually operable pumps positioned in a forward region of the apparatus extending above the water, said pumps being in fluid communication with corresponding laterally spaced inlets formed in the apparatus and with corresponding laterally spaced outlets formed in the forward region of the apparatus, each pump having pistol grip means providing for the secure gripping of the floatation apparatus and for the selective operation of said pumps by the user.

2. Aquatic recreational apparatus comprising:

floatation means for supporting the upper body of a user in a body of water with the lower body of the user extending rearwardly beyond a rearward region of said floatation means and inclining said floatation means at least slightly relative to the surface of the body of water, said floatation means having an inlet in the rearward region thereof that is submersed in the body of water and an outlet in a forward region thereof that extends above the surface of the body of water, said floatation means being maneuverable by the user's kicking his or her feet, and user-actuable means connected with said floatation means for conveying water between said inlet and said outlet and for directing the water from said outlet toward a desired target remote from said apparatus, wherein the stream of water's trajectory is fixed by the configuration of said outlet in said forward region of said floatation means, whereby said floatation means is maneuverable by the user into a position that aligns such trajectory with such target, wherein said conveying-directing means includes dual laterally spaced pumps interposed said rearward and forward regions of said floatation means and operatively connected in fluid communication with said inlet and said outlet, each of said pumps being independently operable for directing water from said outlet.

3. Recreational apparatus comprising:

floatation means for supporting the upper body of a user in a body of water with a rearward region of said floatation means submersed therein and with a forward region of said floatation means extending thereabove, and user-actuable means connected with said floatation means for conveying water from said rearward region to said forward region of said floatation means and for directing the water toward a desired target remote from said apparatus, wherein said conveying-directing means includes dual laterally spaced pumps interposed said rearward and forward regions of said floatation means and at least one first fluid conduit extending from an inlet formed in said floatation means to one side of each of said pumps, each of said pumps having a corresponding second fluid conduit extending from another side of said pump to a corresponding outlet in the forward region of said floatation means, each of said pumps when operated providing a pressure differential from said one to said other side, each of said pumps being independently operable by trigger means for selectively directing water from a corresponding one of said outlets.

4. The apparatus of claim 3, further comprising dual laterally spaced handles rigidly joined with said floatation means to provide for the secure gripping of said floatation means by the user, wherein each of said trigger means is located adjacent a corresponding one of said handles, whereby each of said trigger means is actuable by a user while the user is gripping said handles.

* * * * *